US006523924B1

(12) United States Patent
Adkins et al.

(10) Patent No.: US 6,523,924 B1
(45) Date of Patent: Feb. 25, 2003

(54) PRINTER METHOD FOR REDUCING EFFECT OF PAPER FEED ERRORS

(75) Inventors: Christopher Alan Adkins, Lexington, KY (US); Michael Anthony Marra, III, Lexington, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/930,792

(22) Filed: Aug. 16, 2001

(51) Int. Cl.[7] ..... B41J 2/01
(52) U.S. Cl. ..... 347/16
(58) Field of Search ..... 347/16, 41, 43, 347/104

(56) References Cited

U.S. PATENT DOCUMENTS 4,989,019 A 1/1991 Loce et al.
5,644,683 A 7/1997 Ross et al.
5,729,277 A 3/1998 Morrison
5,777,638 A 7/1998 Salter et al.
5,846,007 A 12/1998 Nakayama et al.
5,920,336 A 7/1999 Lawton et al.
5,929,892 A 7/1999 Towner et al.
6,017,114 A * 1/2000 Elgee et al. ..... 347/40
6,025,922 A 2/2000 Marsden
6,068,366 A * 5/2000 Bolash et al. ..... 347/43
6,137,592 A 10/2000 Arquilevich et al.

* cited by examiner

*Primary Examiner*—Craig Hallacher
(74) *Attorney, Agent, or Firm*—Thompson Hine LLP; Jacqueline Daspit

(57) ABSTRACT

A method for reducing horizontal banding on media in an ink jet printer involves the step of moving the media repeatedly back and forth along a media movement path during a printing scan of at least one print head, the printing scan defined by movement of the print head across the media movement path as ink is ejected from the print head onto the media.

21 Claims, 2 Drawing Sheets

PRINTER METHOD FOR REDUCING EFFECT OF PAPER FEED ERRORS

TECHNICAL FIELD

The present invention relates generally to printers and, more particularly, to a method for reducing the effect of paper feed errors on the visual quality of printed images.

BACKGROUND OF THE INVENTION

Printers such as inkjet printers typically include a paper indexing mechanism such as a paper feed roller the movement of which may be controlled by a motor through a gear arrangement. During a printing operation paper is moved or indexed along a paper path, stopped and then a print head carriage is moved across the paper path to eject ink onto the paper. The paper is indexed again, stopped and the print head carriage is again moved across the paper path. If an error occurs in the indexing, the resulting position of ink on the paper will be off slightly from the intended or desired position, which can result in undesired banding in the resultant printed image. Because the banding tends to be uniform and horizontal across the width of the paper, the banding tends to be visible in the resultant printed image. In the past a technique known as "shingling" has been reduced to introduce some randomness in the printer image in order to reduce the effect of indexing errors. Shingling involves the use of multiple printing scans during which image pixels are overlapped. However, shingling increases throughput time for a given printed image by increasing the number of printing scans required.

Accordingly, it would be advantageous to provide a technique for reducing banding caused by paper feed/indexing errors in ink jet printers.

SUMMARY OF THE INVENTION

In one aspect, a method for reducing horizontal banding on media in an ink jet printer involves the step of moving the media repeatedly back and forth along a media movement path during a printing scan of at least one print head, the printing scan defined by movement of the print head across the media movement path as ink is ejected from the print head onto the media.

In another aspect, a printing method for an ink jet printer involves the steps of: (a) moving a media along a media movement path of the printer into a first printing position range, (b) performing a first printing scan of a print head, the first printing scan defined by movement of the print head across the media movement path as ink is ejected onto the media from the print head; and (c) during the first printing scan, moving the media repeatedly back and forth along the media movement path and within the printing position range. The aforementioned method may involve the further steps of (d) moving the media along the media movement path into a second printing position range; (e) performing a second printing scan of the print head, the second printing scan defined by movement of the print head across the media movement path as ink is ejected onto the media from the print head; and (f) during the second printing scan, moving the media repeatedly back and forth along the media movement path and within the second printing position range.

In a further aspect, an ink jet printing system includes a paper movement path and a print head carriage mounted for movement across the paper movement path and having at least one print head mounted thereon. A paper indexing arrangement includes a paper feed roller, a motor operatively coupled for rotating the paper feed roller, an encoder operatively connected for producing output signals indicative of paper feed roller position and a motor drive control connected to control energization of the motor, the motor drive control receiving the output signals of the encoder. During a printing scan defined by movement of the print head carriage across the paper movement path as ink is ejected from the print head onto paper, the motor drive control controls energization of the motor for repeatedly varying a rotation direction of the paper feed roller in order to repeatedly move the paper back and forth along the paper movement path.

In yet another aspect, an ink jet printing system includes a paper movement path and a print head carriage mounted for movement across the paper movement path and having at least one print head mounted thereon. A paper indexing arrangement includes a paper feed roller, a motor operatively coupled for rotating the paper feed roller, and a motor drive control connected to control energization of the motor. During a printing scan defined by movement of the print head carriage across the paper movement path as ink is ejected from the print head onto paper, the motor drive control controls energization of the motor for repeatedly varying a rotation direction of the paper feed roller in order to repeatedly move the paper back and forth along the paper movement path.

DETAILED DESCRIPTION

Figure 1:
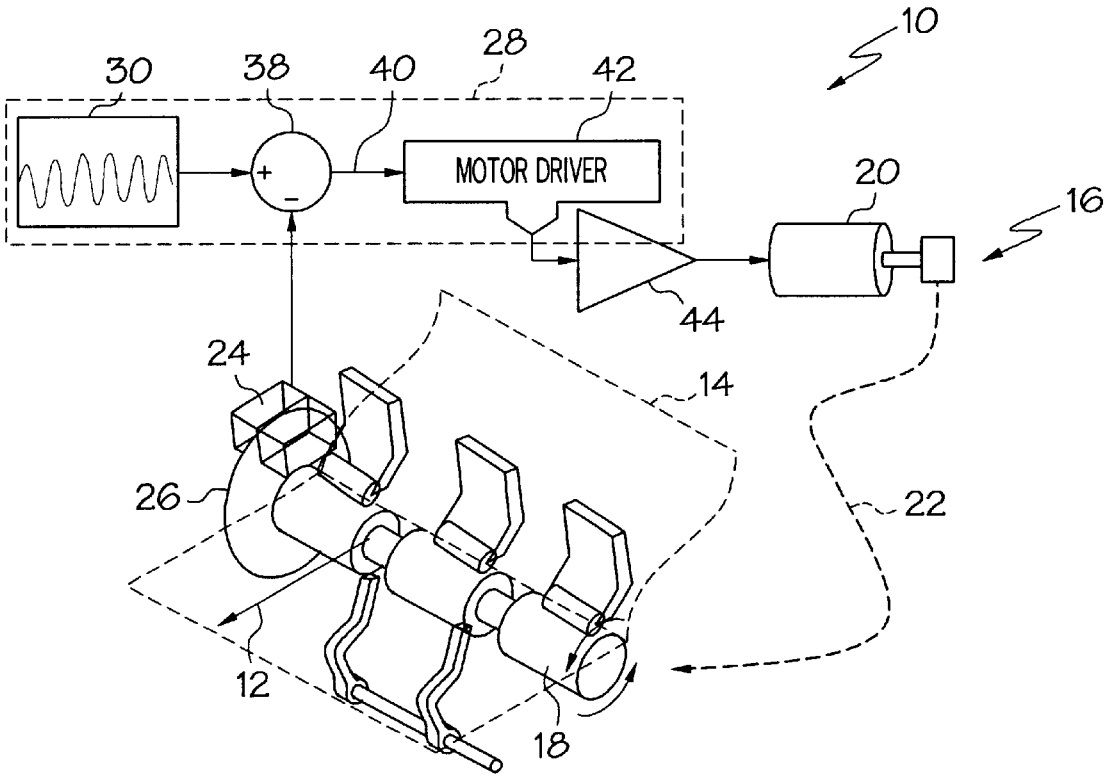
FIG. 1 is a schematic of one embodiment a printer system.

Referring to FIG. 1, a representative ink jet printing system 10 is shown. The system 10 includes a paper movement path shown by arrows 12 along which paper 14 is moved for printing. While the term paper is used throughout this description, it is recognized that use of the invention in connection with other media is intended to be covered. The paper 14 is moved along the paper movement path 12 by a paper indexing arrangement 16 formed by a segmented paper feed roller 18 which is driven via operative connection to a motor 20. The motor 20 may be a DC motor. The connection 22 between motor 20 and feed roller 18 is shown schematically and could be formed by any number of known techniques including gear arrangements and belt drives. A rotary encoder 24 includes a rotating, windowed mask 26 connected for rotation with the feed roller 18 for producing output signals indicative of feed roller position/movement. The encoder output signals are delivered to a motor drive control 28.

Figure 2:
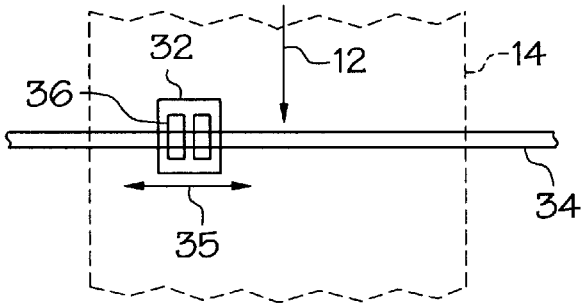
FIG. 2 is a schematic top view of a print head mounted for movement across the paper movement path.

In one embodiment, the motor drive control 28 includes a reference position generator 30 which is utilized during a printing scan. Reference is made to the schematic of FIG. 2 which shows a print head carriage 32 mounted for movement across the paper movement path 12, such as by movement on a carriage slide rod arrangement 34. The carriage 32 may be mounted for back and forth movement substantially perpendicular to the movement of paper along the paper movement path as shown at 35, but variations to such perpendicularity are possible. The print head carriage 32 includes at least one, and typically multiple ink jet print heads 36 mounted thereon such that the print heads are also moved across the paper movement path during a printing scan. In this regard, a printing scan may be defined as movement of at least one print head across the paper movement path while ink is ejected onto the paper to produce an image on the paper. The motor drive control 28 may also receive an indicator of when a printing scan takes place.

Referring again to FIG. 1, during a printing sequence the reference position signal may be compared with the encoder output signals at 38 to produce a drive correction signal at 40 which is provided to a motor driver 42. The motor driver 42 controls energization of the motor through an amplifier stage 44 and adjusts its energization based upon the drive correction signal 44. Thus, in this arrangement a feedback loop is set up to move the paper feed roller 18 in accordance with the output of the reference position generator 30. The reference position generator 30 may be a set pattern stored and retrieved from memory or may comprise a more randomly software or hardware generated pattern with set limits.

Figure 3:
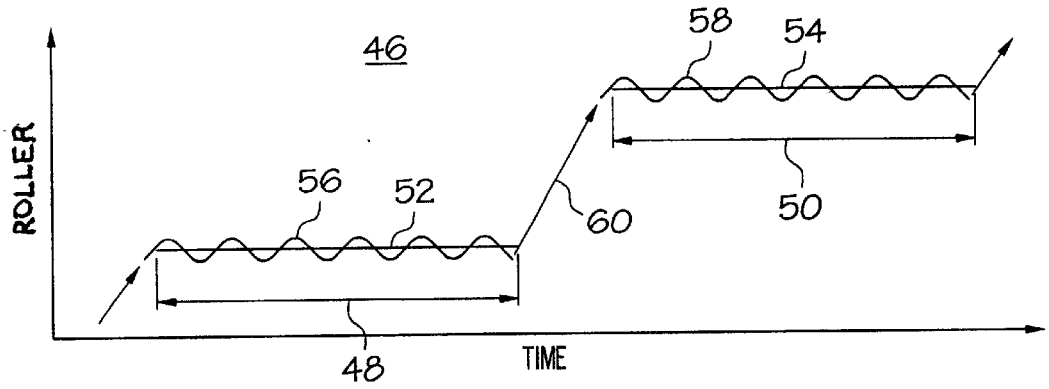
FIG. 3 is a graph depicting media/feed roller movement for two printing sequences.

Notably, the system 10 facilitates the reduction of banding in images printed on the paper 14, and therefore also reduces the amount of shingling needed. In particular, referring to FIG. 3 a graph 46 of roller position verses time for two printing sequences 48 and 50 is shown. For each sequence 48, 50 a standard, nonmoving feed roller position previously used is shown at 52, 54. Also shown is one embodiment of a back and forth, moving feed roller position 56, 58 which may be utilized for the reduction of banding. Moving the feed roller 18 back and forth during the printing scans reduces the effect of any error which might have occurred during indexing by movement of the paper 14 during printing. The back and forth paper movement during printing makes indexing errors less noticeable in the printed image because such errors no longer show up as a continuous, horizontal band. An indexing movement 60 between printing sequences is also shown.

Figure 4:
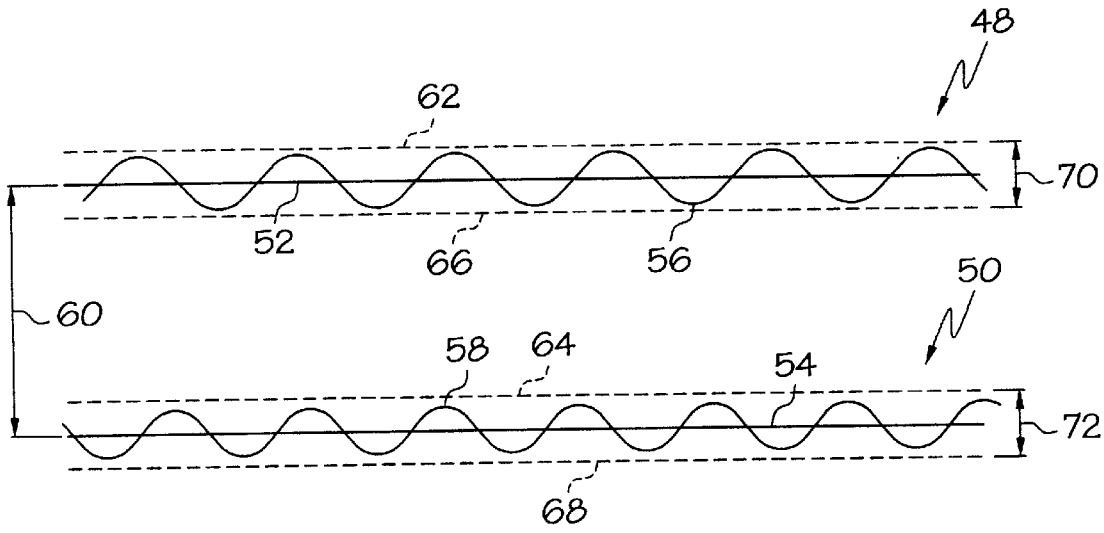
FIG. 4 is a depiction of media movement for two printing sequences along a length of media.

Referring now to FIG. 4, it is recognized that back and forth movement of the paper may be limited in some manner during each printing scan so as not to adversely affect the quality of the image produced. In this regard, upper 62, 64 and lower 66, 68 limits for the paper/feed roller movement during each printing scan are shown. It is anticipated that the established movement windows/ranges 70 and 72 may be on the order of one half (½) to twenty-five (25) microns, but that other ranges might also be used depending upon the relative size and arrangement of various printer components as well as acceptable image quality.

In accordance with one printing method, the following steps may be performed. The paper 14 is moved along the paper movement path 12 of the printer into a first printing position range 70. A first printing scan of the print head 36 is performed, the first printing scan defined by movement of the print head 36 across the media movement path 12 as ink is ejected onto the paper 14 from the print head 36. During the first printing scan, the paper 14 is moved repeatedly back and forth along the media movement path within the printing position range 70 as shown at 56. The paper 14 may then be moved along the media movement path 12 into a second printing position range 72. A second printing scan of the print head 36 is performed, the second printing scan defined by movement of the print head 36 across the paper movement path 12 as ink is ejected onto the paper 14 from the print head 36. During the second printing scan, the paper 14 is moved repeatedly back and forth along the media movement path within the second printing position range 72 as shown at 58.

Although the invention has been described above in detail referencing the preferred embodiments thereof, it is recognized that various changes and modifications could be made without departing from the spirit and scope of the invention. For example, while a feedback system utilizing a DC motor and encoder is shown in the illustrated embodiment, it is contemplated, for example, that a stepper motor might be used to drive the feed roller and that the stepper motor could be micro-stepped back and forth during printing scans without the need for feedback from a feed roller encoder.

What is claimed is:

1. A method for reducing horizontal banding on media in an ink jet printer, the method comprising the steps of:

moving the media repeatedly back and forth along a media movement path during a printing scan of at least one print head, the printing scan defined by movement of the print head across the media movement path as ink is ejected from the print head onto the media.

2. The method of claim 1 wherein the movement of the media back and forth follows a set pattern.

3. The method of claim 1 wherein the movement of the media back and forth is random within set limits.

4. The method of claim 1 wherein the media is moved via an indexing system comprised by a DC motor operatively coupled to move a media feed roller, an encoder providing feedback signals concerning position of the media feed roller, and a motor drive control receiving the feedback signals and controlling the DC motor based upon the feedback signals.

5. The method of claim 1 wherein the media is moved back and forth via an indexing system comprised of a stepper motor operatively coupled to a feed roller.

6. The method of step 1 including the steps of:

producing feedback signals indicative of media position;

comparing the feedback signals to a reference position signal; and controlling the back and forth movement of the media based upon the comparison.

7. The method of step 1 including the steps of:

establishing a movement range; and controlling the back and forth movement of the media to be within the movement range.

8. The method of claim 7 wherein a size of the movement range is no more than twenty-five microns.

9. A printing method for an ink jet printer, the method comprising the steps of:

(a) moving a media along a media movement path of the printer into a first printing position range;

(b) performing a first printing scan of a print head, the first printing scan defined by movement of the print head across the media movement path as ink is ejected onto the media from the print head; and (c) during the first printing scan, moving the media repeatedly back and forth along the media movement path and within the printing position range.

10. The method of claim 9 including the further steps of:

(d) moving the media along the media movement path into a second printing position range;

(e) performing a second printing scan of the print head, the second printing scan defined by movement of the print head across the media movement path as ink is ejected onto the media from the print head; and (f) during the second printing scan, moving the media repeatedly back and forth along the media movement path and within the second printing position range.

11. The method of claim 9 wherein during step (c) the media is moved in a set pattern within the first printing position range.

12. The method of claim 9 wherein during step (c) the media is moved randomly within the first printing position range.

13. The method of claim 9 wherein the media is moved via an indexing system comprised by a DC motor operatively coupled to move a media feed roller, an encoder providing feedback signals concerning position of the media feed roller, and a motor drive control receiving the feedback signals and controlling the DC motor based upon the feedback signals.

14. The method of claim 9 wherein the media is moved via an indexing system comprised by a stepper motor operatively coupled to move a media feed roller.

15. The method of claim 9 wherein in step (c) feedback signals indicative of media position are produced, the feedback signals are compared to a reference position signal, and the back and forth movement of the media is controlled based upon the comparison.

16. The method of claim 9 wherein in step (c) a movement range is established and the back and forth movement of the media is controlled to be within the movement range.

17. An ink jet printing system, comprising:

a paper movement path;

a print head carriage mounted for movement across the paper movement path and having at least one print head mounted thereon;

a paper indexing arrangement including:

a paper feed roller;

a motor operatively coupled for rotating the paper feed roller;

an encoder operatively connected for producing output signals indicative of paper feed roller position;

a motor drive control connected to control energization of the motor, the motor drive control receiving the output signals of the encoder;

wherein, during a printing scan defined by movement of the print head carriage across the paper movement path as ink is ejected from the print head onto paper, the motor drive control controls energization of the motor for repeatedly varying a rotation direction of the paper feed roller in order to repeatedly move the paper back and forth along the paper movement path.

18. The printing system of claim 17 wherein the drive motor comprises a DC motor.

19. The printing system of claim 17 wherein during the printing scan the motor drive control controls energization of the motor for repeatedly varying the rotation direction of the paper feed roller in a set pattern.

20. The printing system of claim 17 wherein during the printing scan the motor drive control controls energization of the motor for repeatedly varying the rotation direction of the paper feed roller in a random pattern.

21. An ink jet printing system, comprising:

a paper movement path;

a print head carriage mounted for movement across the paper movement path and having at least one print head mounted thereon;

a paper indexing arrangement including:

a paper feed roller;

a motor operatively coupled for rotating the paper feed roller;

a motor drive control connected to control energization of the motor;

wherein, during a printing scan defined by movement of the print head carriage across the paper movement path as ink is ejected from the print head onto paper, the motor drive control controls energization of the motor for repeatedly varying a rotation direction of the paper feed roller in order to repeatedly move the paper back and forth along the paper movement path.

* * * * *